US006243909B1

(12) United States Patent
Graham et al.

(10) Patent No.: US 6,243,909 B1
(45) Date of Patent: Jun. 12, 2001

(54) DUST MOP WITH REPLACEABLE ELECTROSTATICALLY

(76) Inventors: Barbara Graham, 4708 18th St., Lubbock, TX (US) 79416; Katherine L. Kilman, 3212 44th, Lubbock, TX (US) 79413; Robert L. Graham, 4708 18th St., Lubbock, TX (US) 79416

( * ) Notice: Subject to any disclaimer, the term of this patent is extended or adjusted under 35 U.S.C. 154(b) by 0 days.

(21) Appl. No.: 09/313,239

(22) Filed: May 17, 1999

Related U.S. Application Data

(60) Provisional application No. 60/118,125, filed on Feb. 1, 1999.

(51) Int. Cl.[7] ..... A47L 13/40

(52) U.S. Cl. ..... 15/228; 15/1.52; 15/231

(58) Field of Search ..... 15/1.52, 228, 231

(56) References Cited

FOREIGN PATENT DOCUMENTS

166436 * 3/1934 (CH) ..... 15/1.52

* cited by examiner

*Primary Examiner*—Randall E. Chin
(74) *Attorney, Agent, or Firm*—R. L. Graham; G. M. Graham

(57) ABSTRACT

A dust mop features a dust collector layer made of electrostatically charged nonwoven fabric. The electrostatic charge (a) enables the dust collector to be detachably mounted to the mop head by electrostatic cling; and (b) improves the dust collecting ability of the dust collector.

12 Claims, 2 Drawing Sheets

DUST MOP WITH REPLACEABLE ELECTROSTATICALLY

REFERENCE TO RELATED APPLICATION

This is a continuation of Provisional U.S. patent application Ser. No. 60/118,125, filed Feb. 1, 1999.

BACKGROUND OF THE INVENTION

This invention relates to a dust mop provided with an electrostatically charged thermoplastic fabric (dust collector) for attracting dust particles such as those commonly found in households. In one aspect it relates to a mop having a charged nonwoven thermoplastic fabric detachably secured to the mop head, wherein the charges in the fabric attract and hold dust particles. In a more specific aspect, it relates to a dust mop having an electrostatically charged meltblown fabric which is detachably secured to the mop head by electrostatic cling.

As is widely known, the activity of dusting to remove unwanted and/or unsanitary dust particles is a common household or office task. In many situations the task can be accomplished with a dust rag and a simple wipe-of-the-hand. There are, however, many other situations where the task becomes more complicated. These include hard-to-reach places such as around floorboards, the upper portion of a walls and ceilings, on floors such as hardwood floors, and ceiling fans.

The present invention provides a dust mop that which not only facilitates dusting in difficult areas but has a dust collector that can be changed easily. As described in detail below, the dust collector of the mop is made of electrostatically charged nonwoven fabric. A brief description of the more important nonwoven fabrics may be helpful: meltblowing and spunbonded fabrics.

Meltblowing is a process wherein a molten polymer is extruded through a meltblowing die to form a plurality of side-by-side fibers. Convergent sheets of air are directed onto opposite sides of the fibers as they leave the die. The air draws and attenuates the fibers to microsized diameters (viz. 0.05–15 microns). The fiber and air stream is directed onto a moving collector surface where the fibers deposit in a random pattern and form a nonwoven fabric or web. The fabric is held together primarily by interfiber entanglement with some fiber sticking while in the molten or semi-molten state. The fibers may be continuous or discontinuous filaments. By varying operating conditions, meltblown fabrics having different basis weights may be produced.

It is well-known in the art of meltblowing to apply an electrostatic charge to the fibers as they are extruded or, alternatively, after the fabric is formed. Electrostatically charged meltblown webs are often referred to as electrets. Electrets were originally developed for gas filtration applications wherein the charges act to attract particulate matter that flows through the web. Since most nonwoven webs are dielectrics, the charge is very persistent and may be sustained for periods of a year or longer. U.S. Pat. Nos. 4,215,682 and 4,904,174 disclose apparatus for producing electrets by the "hot charging" method as well as test data indicating the filtration efficiency of the webs. PCT application PCT/US/93/09630, and its U.S. counterpart U.S. Pat. No. 5,401,446, disclose "cold charging" methods and apparatus for producing electrets.

Spunbonded fabrics are nonwoven fabrics that are produced by extruding a molten polymer through a spinneret that is a metal disc or die containing numerous minute holes through which the polymer is forced. Continuous filaments are extruded through the spinneret and are blown by low velocity air and deposited on a moving foramenous conveyer. The desired orientation of the filaments in the web are achieved by rotating the spinneret, by electrical charges, by controlled airstreams, and by the speed of the conveyer. The web can be additionally bonded by passing through compacting rolls and/or hot-roll calendering. Spunbonded webs generally have larger average diameter filaments (viz. 10–100 microns, typically 20 to 60 microns) than meltblown webs and, therefore, tend to be heavier and stiffer. Spunbonded webs can be electrostatically charged by methods described in U.S. Pat. Nos. 4,592,815; 4,375,718; and 5,401,446.

A paper presented at "Fiber Producer Conference 1983", in Greenville, S.C. entitled "Nonwoven Fabrics: Spunbonded and Meltblown Processes" describes the two processes in detail. The disclosures of this paper and the above noted patents are incorporated herein by reference.

SUMMARY OF THE INVENTION

The present invention provides a dust mop which collects dust particles through the action of an electrostatic attraction between the dust collector layer (charged nonwoven layer) and the dust particles. The mop comprises a handle with a mop head secured to the bottom of the handle. The head comprises a rigid member which may have a layer of padding material (batting, sponge, fabric layer, etc.) secured to the underside of the member. The head may further include a bag-shaped cloth cover that is placed over the mop head and covers the padding layer. The cover may be removably secured to the rigid mop head member using an elastic band. A layer of electrostatically charged nonwoven fabric (dust collector), which carries a persistent electrostatic charge on each side of the layer, is placed over the cover. The electrostatically charged nonwoven fabric is the duct collector and is in the form of a layer. The charges on the nonwoven fabric cause it to cling to the cloth cover thereby securing this layer to the cover. The charged fabric is thereby detachably secured to the cover solely by electrostatic cling.

The exposed side of the charged layer defines the working surface of the mop head and acts as the dust collector. The charged dust collector layer surface is brought into contact or into close proximity with the dust to be collected. The dust particles are attracted to the dust collector layer and cling thereto under the action of electrostatic attraction whereby the dust is collected for disposal. After repeated use the dust collector layer surface will become soiled, at which time it can be detached from the cloth cover by simply pulling the dust collector layer away from the cloth cover. A new charged collector layer may be installed by smoothing a new collector layer onto the mop head cover.

The electrostatic charge on the nonwoven collector fabric thus serves two functions: (1) it permits the collector to be detachably mounted on the mop head by electrostatic cling requiring no screws, clips, or similar connectors; and (2) it attracts and collects dust particles.

DESCRIPTION OF THE PREFERRED EMBODIMENTS

In order to better understand the present invention, the following terms need defining:

Fabric: A sheet structure made from synthetic fibers, filaments or yarns. (The terms fibers and filaments are used interchangeably herein.)

Nonwoven: A manufactured sheet, web, or batting of directionally or randomly oriented fibers, made by bonding or entangling fibers through mechanical, thermal, or chemical means. They exclude continuous films, paper, and products which are woven, knitted, tufted, or felted by wet-milling. For purposes of the present invention, the fibers are synthetic.

Meltblown Fabric: Nonwoven fabric made by the conversion of molten polymer to a web: the molten plastic is blown with hot, high-velocity air through extruder die tips. The filaments exiting from the extruder are attenuated during their formation until they break. The fibers break into short lengths, rather than being continuous as those formed from the spinneret used in spunbonding. The short fibers, thereby created, are spread with cool quench air onto a moving belt called a forming fabric, or onto a drum, where they bond to each other on cooling, to form a white, opaque, fine-fibered web.

Spunbonded Fabric: Nonwoven fabric made by the conversion of molten polymer to a web. Continuous filaments are extruded through a spinneret, a device with tiny holes like a shower nozzle. The filaments are blown about and spread on a moving belt, called a forming fabric or wire. The hot filaments are still sufficiently molten to adhere and thereby bond to themselves at their crossover points. The desired orientation of the fibers in the web are achieved by rotating the spinneret, by electrical charges, by controlled airstreams, and by the speed of the belt. The web can be additionally bonded by passing through compaction rolls and/or hot-roll calendering.

Thermoplastics or Thermoplastic Polymers: A high polymer that softens when exposed to heat and returns to its original condition when cooled to room temperature. The term is usually applied to synthetics such as polyvinyl chloride, nylons, fluorocarbons, polyethylene, polypropylene, polyurethane prepolymer, polystyrene, polypropylene, and cellulosic and acrylic resins.

Electrostatic Charge: Stationary electrons on a surface of a fabric.

Electrostatic Cling: The electrostatic attraction of a layer to an electrostatically charged layer to cause the two layers to adhere together. One layer or both layers may be charged.

Figure 1:
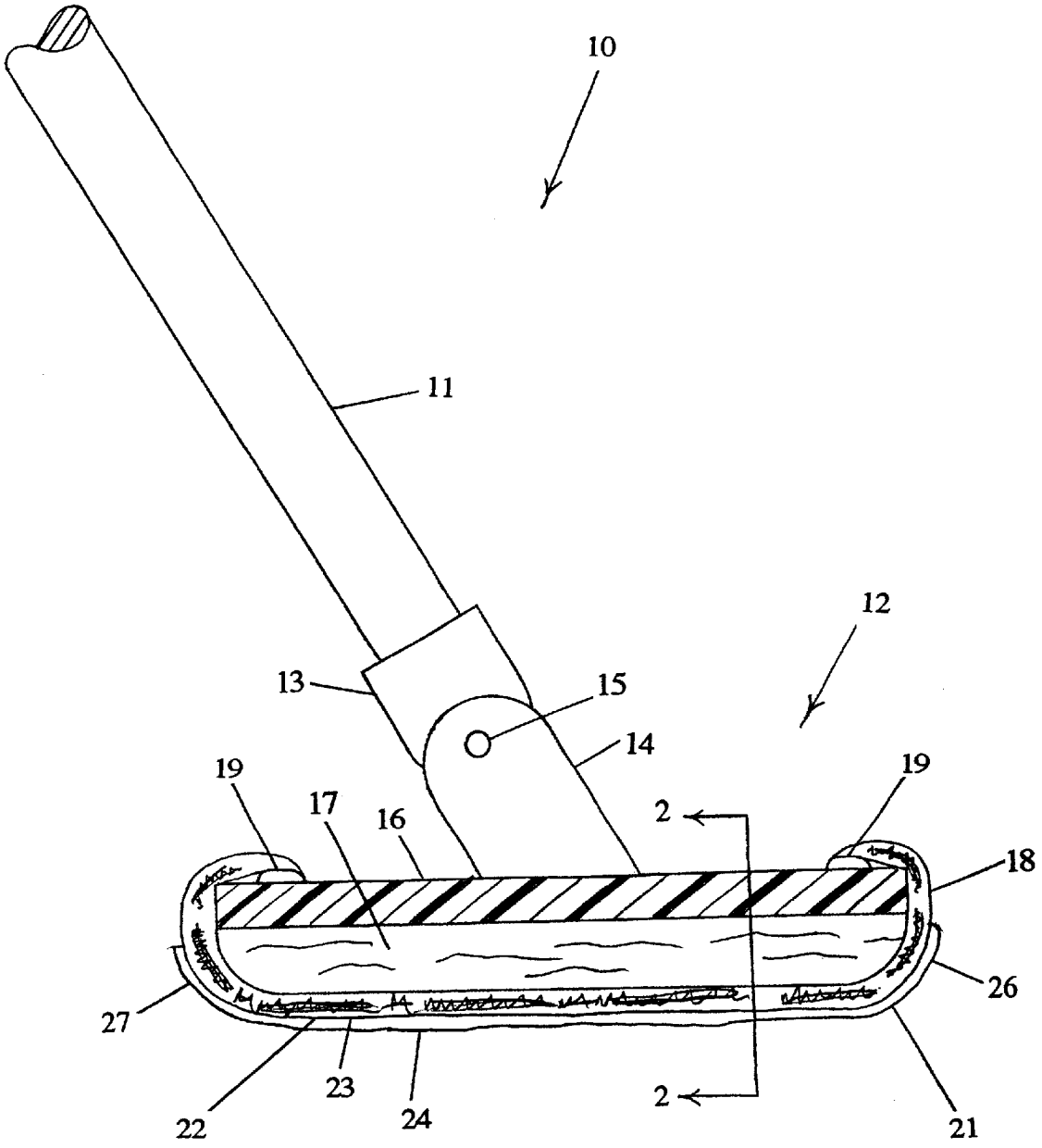
FIG. 1 is a side sectional view of the present invention.
Figure 2:
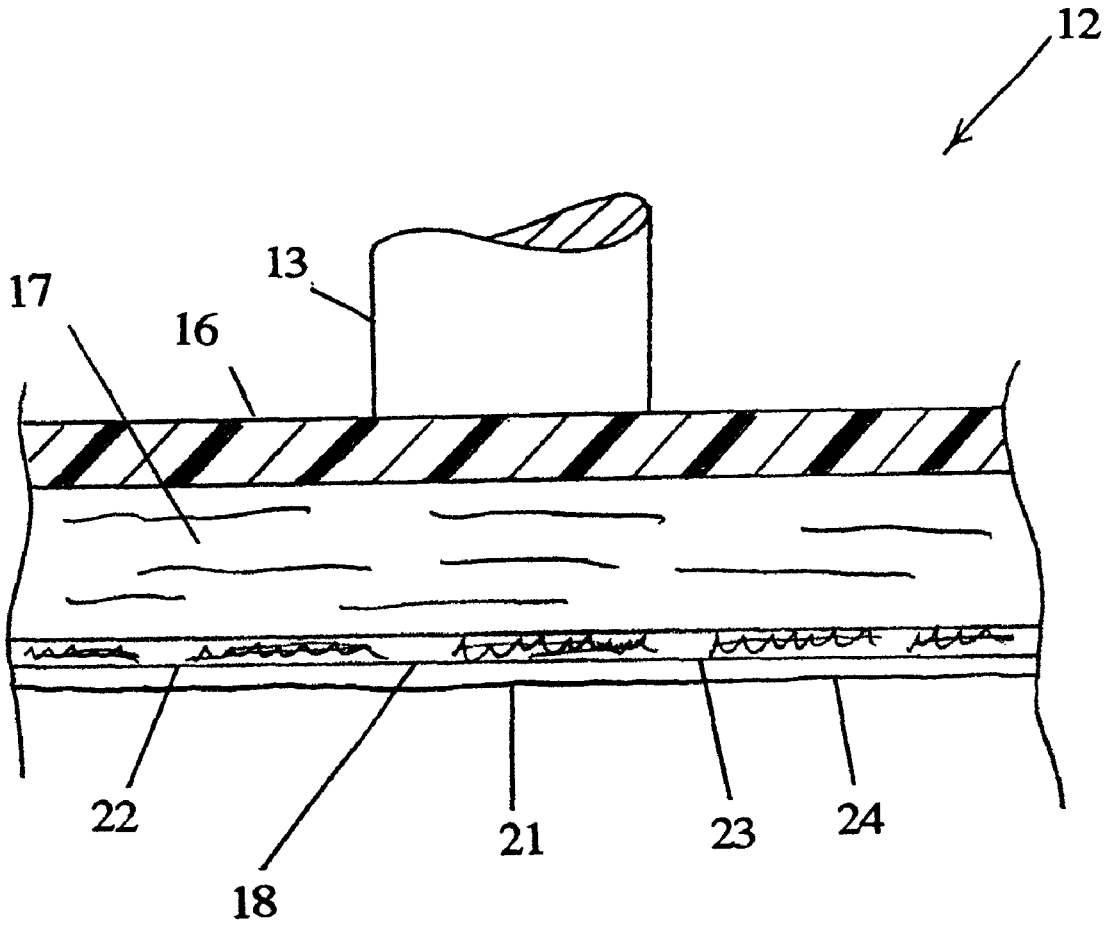
FIG. 2 is a fragmentary frontal sectional view of the mop head, with the cutting plane along line 2—2 of FIG. 1.

Referring to FIGS. 1 and 2, the present electrostatic dust mop 10 comprises elongated handle 11 and head 12. The handle and head are joined using connectors 13 and 14 at pivot 15 whereby head 12 may pivot with respect to handle 11 to facilitate the task of dust collection. The handle may also include a swivel/pivot connector (not shown) to permit head swiveling and pivoting in relation to the handle.

As is widely practiced in the art, handle 11 and connector 13 may be constructed from any suitable material including wood, plastic, or metal. Handle 11 will generally have external threads (not shown) at one end that will mate with internal threads in connector 13 for securing the connector to the handle. Alternatively, the handle and connector may be of integral design as is widely known in the art.

Head 12 comprises rigid support member 16 that may be integral with connector 14 or secured thereto by any suitable means. The rigid member and connector may be constructed from plastic or metal as is widely known in the art. Although not essential, but highly desirable, the plastic head 12 may further include a padding layer 17 which is secured to support 16 and substantially covers the entire underside of support 16. Layer 17 may be constructed from a number of materials including batting such as cotton batting, fabric layer(s), or flexible foamed plastic. Layer 17 may be secured to member 16 by any suitable means such as adhesives. The design and construction of the aforementioned components of mop 10 may be of various design without departing from the spirit of the present invention.

Mop head 12 preferably has secured thereto bag-shaped cloth cover 18 which has elastic band 19 attached to the cover around its periphery. Cover 18 and band 19 are sized so that the cover may be removably placed around padding layer 17 to entirely cover it. In the operating position, cover 18 and elastic band 19 are sized so that the cover is held snugly in place around support 16 and layer 17 with the band resting on the upper surface of support 16 as illustrated in FIG. 1. Thus cover 18 may be easily removed from support 16 by stretching elastic band 19. Cover 18 may be made of knitted or woven fabric capable of clinging to the duct collector layer described below. Woven or knitted fabrics include cotton, wool, synthetics and the like.

Cover 18 has outer downwardly facing surface 22 which provides support for dust collector layer 21. Layer 21 comprises an electrostatically charged nonwoven fabric which carries a persistent or semi-persistent electrostatic charge on both inner surface 23 and outer surface 24. The charge on the inner surface creates electrostatic cling between the outer surface 22 of cover 18 which is of sufficient magnitude to secure collector 21 to the cover with no other connector means required and to hold collector 21 in place during the operation of the mop.

Outer surface 24 of electrostatic collector layer 21 acts as the dust collector. The electrostatic charge carried by surface 24 is sufficient to attract and hold dust particles thereto. For dusting a wall or the like surface 24 is wiped over the surface. Any dust particles present will become polarized by the electrostatic charges on surface 24 and will cling to the surface. Once surface 24 has become covered with dust it may be peeled manually from cover 18 and replaced with a new collector sheet. The preferred material for the collector layer is a meltblown web having the properties tabulated above.

The collector layer 21 may be made from commercially available nonwovens which are electrostatically charged by a number of well-known processes. For example, U.S. Pat. Nos. 5,401,446, 4,592,815, and 4,375,718 disclose cold charging methods for electrostatically charging thermoplastic webs. U.S. Pat. Nos. 4,215,682 and 4,904,174 disclose electrostatic charging of meltblown fibers during the process. The disclosures of these patents, particularly U.S. Pat. No. 5,401,446, are incorporated herein by reference for disclosing methods, compositions, properties, and specification of webs capable of being electrostatically charged.

The nonwoven fabrics for the dust collector 21 may be made and charged by any of the processes described in the above-referenced patents. The preferred charging method, however, is the cold charging method, particularly that described in U.S. Pat. No. 5,401,446. In this process, a nonwoven web or fibers thereof are passed through an electric field, preferably sequential electric fields in accordance with U.S. Pat. No. 5,401,446 to impart a persistent electrostatic charge thereto.

Thin nonwoven webs (e.g. 0.25 oz/yd$^2$) may be used as layer 21, but present problems of tearing. Thicknesses can be as large as practicable. Charges can be negative or positive and should be sufficient to impart cling to layer 21 thereby improve its adherence to the cover. The magnitude of the charges should be as large as possible to achieve maximum cling. The preferred nonwoven fabric for layer 21 is meltblown, but other nonwovens such as spunbonded fabrics may be used. The following properties of meltblown webs are by way of example:

| | Range | Preferred Range | Most Preferred Range |
|---|---|---|---|
| Avg. fiber size (microns) | 1–50 | 1–20 | 1–10 |
| Basis wt. (oz/yd$^2$) | 0.5–5 | 0.75–5 | 1–4.0 |
| Surface charge potential (v) | −2500 to +2500 | | |

The surface charge potential of each surface of layer 21, whether positive or negative, should be in excess of 100 v., preferably in excess of 300 v. and most preferably in excess of 500 v..

The surface charge potential of the web may be determined by Monroe Model 244 Isoprobe Electrostatic Voltmeter with 1017E Probe (0.07 in. opening) connected to a Velmex system which allows webs with dimensions up to 10 in.×38 in. to be scanned with the probe in both matching (MD) and cross-matching (CD) directions. The measurement system is interfaced with an IBM AT computer using DT 3801 I/O system (Data Translation Inc., Marlborough, Mass.). The average value of the surface charge potential may be computed.

The nonwoven fabrics (for use as dust collector layer 21) may be prepared from nonconductive polymeric material such as those selected from the group consisting of polypropylene (PP), recycled and virgin polyethylene terephthalate (PET), all types of polyethylene (PE), such as linear low density polyethylene (LLDPE), polychlorotrifluroethylene (PCTFE), polycyclohexyldimethylene terephthalate (PCT), In addition, the present invention is suitable for charging composite webs containing both conductive and nonconductive fibers such as meltblown/cotton/meltblown thermally bonded webs of meltblown/cotton hydroentangled or needle-punched webs, or hydroentangled mixtures of carded polyester staple fibers and wood tissue, such as SONTARA webs (DuPont). For economics, the preferred thermoplastics are PP, PE<PET, copolymers and blends thereof The most preferred nonwoven layer 21 is meltblown PP. Tolls of nonwoven fabrics are commercially available from a number of companies in a variety of materials, sizes, colors, and specifications. These rolls can be purchased and electrostatically charged.

For purposes of the present invention, the cover 18 need not be removably from the mop head, but instead may be part of the padding layer 17 or secured to member 16. Also, the padding layer is not essential. Its main function is to conform the moping surface to the area being mopped. Thicknesses of ¼ inch to 1 inch of the padding will be satisfactory for most operations.

In preferred operations, a roll of electrostatically charged meltblown fabric (e.g. PP) having an electrostatic charge imparted thereto is cut into strips of the proper size for mounting on the mop head cover 18. The strip size, of course, will depend on the size and geometry of the mop head 12. For a typical mop head, having a length of 2 feet and a width of 6 inches, the dust collector strip will be about 2 feet long and about 7 inches wide to permit the leading and trailing edges of the layer 21 to extend upwardly from the dust area as shown at 26 and 27 of FIG. 1.

The collector strip 21 is attached to the mop head by merely lining up its width and length with the head and smoothing the layer in place. The electrostatic cling causes the collector strip 21 to remain nonmovably secured to the cover 18 in the position shown in FIG. 1. The upward extensions 26 and 27 prevent dust from collecting between collector strip 21 and cover 18. After use, the collector strip may be replaced by merely pulling it off the cover and mounting a new collector strip 21 on the cover.

EXAMPLE

A dust mop was made from a conventional mop. The head was molded plastic about 12 inches long and 4 inches wide. A padding layer of cotton batting was placed on the downwardly facing surface of the head and held in place by a woven cotton cover provided with an elastic band.

A meltblown layer of PP (basis weight of about 1 oz/yd$^2$) was cut to a length of about 12 inches and a width of about 5 inches. The meltblown layer was charged in accordance with U.S. Pat. No. 5,401,446.

The meltblown layer (dust collector 21) readily clung to the cotton cover. The mop was used to dust a wooden floor. After several uses, the dust collector layer 21 was replaced as described above. During the several uses, the meltblown layer 21 retained its position on the mop head.

In one experiment, a wooden floor was dusted with a conventional mop, followed immediately by dusting with the mop of the present invention. The dusting with the mop of the present invention picked up noticeably additional dust, even though the floor had been dusted immediately before with a conventional dust mop. This indicates that the electrostatic attraction of the collector layer 21 improves the dust collecting ability of the mop.

In summary, the mop of the present invention comprises:

(a) a handle;

(b) a mop head secured to one end of the handle; and (c) an electrostatically charged nonwoven layer (dust collector) detachably secured to the mop head by electrostatic cling without the need for other connectors.

The electrostatic charge on the nonwoven layer (preferably meltblown fabric) is achieved by passing the nonwoven layer or fibers thereof through an electric field where a persistent electrostatic charge is imparted to the layer.

The disposable dust collector layer 12 may be mounted on the mop head by cling above or may include other means of detaching the layer 21 from the mop head. For example, the layer may be placed on the covered head and wrapped around the covered head. The layer ends above the head may then be secured together by clips, pins or other connectors. To dispose of the layer 21, the clips are merely removed and the layer pulled off the covered head. Note that cling of the inner surface on the cover is still operative even if ancillary connectors are used. Alternatively, the dust collector layer 21 may have contacts (e.g. extensions or tabs) on each end portions that cling together. In this design the dust collector layer 21 is placed on the cover 18 and wrapped around the head 16 and the contact surfaces are joined together on the top surface of the head 16. The electrostatic charge on the contact surfaces causes them to cling together, maintaining the layer 21 on head 16 without the need of connectors.

What is claimed is:

1. A dust mop comprising (a) a handle;

(b) a mop head secured to one end of the handle;

(c) a cover made of a fabric mounted on the head, and having a downwardly facing surface; and (d) an electrostatically charged thermoplastic nonwoven fabric detachably mounted on the downwardly facing surface of said cover, said electrostatically charged nonwoven fabric having a persistent electrostatic charge imparted thereon by passing the fabric or fibers thereof through an electric field.

2. The mop of claim 1 wherein the cover is padded.

3. The mop of claim 1 wherein the head is rigid.

4. The mop of claim 1 wherein the surface charge on the nonwoven fabric is between −2500 to +2500 v.

5. The mop of claim 1 wherein the nonwoven is selected from the group consisting of meltblown and spunbond fabrics.

6. The mop of claim 5 wherein the fiber size of the nonwoven fabric is between 1 to 50 microns and the fabric has a basis weight between 0.5 to 5 oz/yd$^2$.

7. The mop of claim 1 wherein the head is pivotally mounted on said one end of the handle.

8. The mop of claim 1 wherein the nonwoven fabric is a meltblown fabric having fibers between 1 to 20 microns and having a basis weight between.0.75 to 5 oz/yd$^2$.

9. The mop of claim 1 wherein the nonwoven is made of polypropylene fibers.

10. The mop of claim 1 wherein the electrostatically charged nonwoven fabric has an inner surface in contact with the cover and an outer surface exposed for contacting a surface to be mopped, the inner and outer surfaces each carrying an electrostatic charge whereby the inner surface clings to the cover and the outer surface attracts dust particles.

11. The mop of claim 1 wherein the cover is detachably mounted on the head and is a woven fabric of cotton, wool, and synthetics.

12. A mop comprising (a) an elongate handle;

(b) a rigid head pivotally connected to one end of the handle and having a generally flat downwardly facing surface;

(c) a cloth cover detachably mounted on the head to substantially cover the downwardly facing surface of said head; and (d) a disposable dust collector layer detachably mounted on the cover, said collector layer comprising an electrostatically charged thermoplastic nonwoven fabric having an inner surface in contact with the cloth cover and an outer downwardly layer surface for collecting dust, the nonwoven fabric having fibers between 1 to 50 microns and carrying an electrostatic charge imparted by passing the nonwoven fabric or fibers thereof through an electrostatic field to impart an electrostatic charge on the inner and outer surface of said nonwoven fabric whereby the inner surface clings to the cloth and the outer surface attracts dust particles.

* * * * *